US009784485B2

(12) United States Patent
Ayala Barreto

(10) Patent No.: US 9,784,485 B2
(45) Date of Patent: Oct. 10, 2017

(54) AIR DEHYDRATION AND HEATING DEVICE

(71) Applicant: Francisco Maria Ayala Barreto, Cascavel (BR)

(72) Inventor: Francisco Maria Ayala Barreto, Cascavel (BR)

( * ) Notice: Subject to any disclaimer, the term of this patent is extended or adjusted under 35 U.S.C. 154(b) by 1151 days.

(21) Appl. No.: 13/847,771

(22) Filed: Mar. 20, 2013

(65) Prior Publication Data

US 2013/0298584 A1 Nov. 14, 2013

(30) Foreign Application Priority Data

May 11, 2012 (BR) ..... 1020120111608

(51) Int. Cl.

| | |
|---|---|
| ***F26B 21/06*** | (2006.01) |
| ***F24F 3/044*** | (2006.01) |
| ***F24F 3/153*** | (2006.01) |
| ***F28D 5/00*** | (2006.01) |
| ***F25B 30/02*** | (2006.01) |
| ***F26B 21/08*** | (2006.01) |
| ***F26B 21/10*** | (2006.01) |

(52) U.S. Cl.

CPC ..... *F25B 30/02* (2013.01); *F26B 21/08* (2013.01); *F26B 21/10* (2013.01); *F26B 2200/06* (2013.01)

(58) Field of Classification Search

CPC ..... F24F 3/14; F24F 2003/144; F24F 2003/1446; F24F 11/0015; F26B 21/00; F26B 21/024; F26B 21/028; F26B 21/08; F26B 21/086; F26B 21/10; F26B 21/12; F26B 23/004; F26B 25/005; F26B 2200/06

USPC ..... 62/129, 186, 238.6; 34/77, 72, 75, 90, 34/219, 197

See application file for complete search history.

(56) References Cited

U.S. PATENT DOCUMENTS

| | | | | |
|---|---|---|---|---|
| 4,426,791 A * | 1/1984 | Coppa | F26B 21/06 | 34/515 |
| 4,432,147 A * | 2/1984 | Chen | F26B 3/286 | 34/542 |
| 4,841,733 A * | 6/1989 | Dussault | F24F 5/0071 | 165/223 |
| 4,859,220 A * | 8/1989 | Leber | B01D 46/46 | 55/503 |

(Continued)

FOREIGN PATENT DOCUMENTS

BR WO 2009049390 A1 * 4/2009 ..... A23B 9/10

*Primary Examiner* — Frantz Jules
*Assistant Examiner* — Meraj A Shaikh
(74) *Attorney, Agent, or Firm* — Brian J. Pangrle

(57) ABSTRACT

An air dehydration and heating device can include a first evaporator serpentine and a second evaporator serpentine in parallel and in series with at least one condenser serpentine; a first outside air intake damper for the first evaporator serpentine and a second outside air intake damper for the second evaporator serpentine; a fan motor to drive a fan; a drying air outlet duct to receive air moved by the fan, the air having passed through at least one of the first evaporator serpentine and the second evaporator serpentine and at least one of the at least one condenser serpentine; a return drying air intake damper in a return drying air intake duct; and a processor to control temperature and humidity of drying air in the drying air outlet duct.

13 Claims, 2 Drawing Sheets

(56) References Cited

U.S. PATENT DOCUMENTS

| | | | | |
|---|---|---|---|---|
| 6,338,474 | B1 * | 1/2002 | Semba | H01L 21/67109 165/103 |
| 6,796,223 | B2 * | 9/2004 | Jiang | A23L 3/40 219/400 |
| 7,992,406 | B1 * | 8/2011 | Reece | F28D 5/00 62/259.4 |
| 2004/0108388 | A1 * | 6/2004 | Wacker | F24F 3/153 236/44 C |
| 2005/0056042 | A1 * | 3/2005 | Bourne | F24F 3/044 62/310 |
| 2014/0366577 | A1 * | 12/2014 | Zubrin | F25J 3/0209 62/619 |

* cited by examiner

AIR DEHYDRATION AND HEATING DEVICE

RELATED APPLICATIONS

This nonprovisional patent application claims priority to and the benefit of the filing date of BR PI 10 2012 011160 8, which was filed on 11 May 2012 as an application for a patent of invention (PI) in Brazil by Applicant/Inventor Francisco Maria Ayala Barreto. The application BR PI 10 2012 011160 8 is incorporated by reference herein.

TECHNICAL FIELD

This invention pertains to improvements to air dehydration and heating device for drying solid products.

BACKGROUND

Patent document BR PI 0703605-1 (A), to Ayala Barreto, which is incorporated by reference herein, describes a drying process of sensitive solids, such as seeds and other agricultural products, or solids requiring low temperature drying, in a clean environment and free from contaminations, allowing the storage of agricultural products safely, including in the intense tropical and subtropical weathers, and also allowing a better control on the properties of the air treated by such device, regardless of the outside weather, thus providing functional improvement and more flexibility in its use.

As it is of the knowledge of the technical mean related to the agricultural sector, especially the segment of storage of grains and seeds, there is a demand for alternative solutions for the drying process of these products, aiming reduction of loss and maintenance of the physiologic and sanitary quality of the products, from the harvest to their industrialization or sowing (in case of seeds). In the industry, other solids sensitive to temperature may use this process, since the low temperature and low humidity drying air keep the characteristics of the products.

The equipment disclosed by the patent document PI 0703605-1 is provided with an air dryer with pleated air filter (1) of large capacity for the retention of dust and air impurities, evaporator serpentine (2), compressor (3), centrifugal fan (4), condenser (5), and primary air outlet duct (6), command panel (7), outer air intake damper for mixture (8), power panel (9), outlet air temperature sensor (10), outlet air relative humidity sensor (11), outlet air temperature PID controller (12), outlet air relative humidity PID controller (13), frequency inverter for compressor (14), evaporator outlet air temperature sensor (15), outlet air temperature PID controller of the evaporator (16), frequency inverter (17), cooling fluid expansion valve (18), intake air temperature sensor (19), intake air relative humidity sensor (20), enthalpy calculation processor (21), and main processor (22).

The functioning of the process and the device of the patent document PI 0703605-1 occurs as follows: air humidity is extracted from the condensation of the water vapor in the evaporator serpentine and the relative humidity is reduced by the addition of sensible heat into the condenser serpentine. The modulation of the frigorific power from 0 to 100% occurs automatically by means of the frequency inverter, or step motor, or DC motor, or hydraulic motor, from signals coming from the outlet air temperature PID controller (12) and the outlet air relative humidity PID controller (13).

The device of the patent document PI 0703605-1 has met the expectations, however, within a policy of ongoing improvement, further research and development conducted culminated in the obtainment of a functional improvement and greater flexibility of use.

SUMMARY

As described herein, various improvements to air dehydration and heating have been developed to improve an air dehydration and heating device with controlled temperatures and humidity, for example, as in the patent document PI 0703605-1, through rearrangement of the layout of serpentines of evaporators in parallel with and laterally to a fan, obtaining greater condensation flows and rearrangement of an air intake (e.g., for "new" or "fresh", ambient air) and recirculation air through interconnected lateral plenums, through introduction of two dampers to regulate the mixture of new air with re-circulated air, through installation of sensors and controls of drying air properties and return of the drying equipment for the decision on which air to use, new or re-circulated, and respective quantities, and installation of air properties sensors and controls at the intake of evaporators, as to process the drying air within the desired specifications of temperature and humidity, providing functional improvement and more flexibility of use.

BRIEF DESCRIPTION OF THE DRAWINGS

For a better understanding of this patent, the following figures are attached hereto.

DETAILED DESCRIPTION

Figure 1:
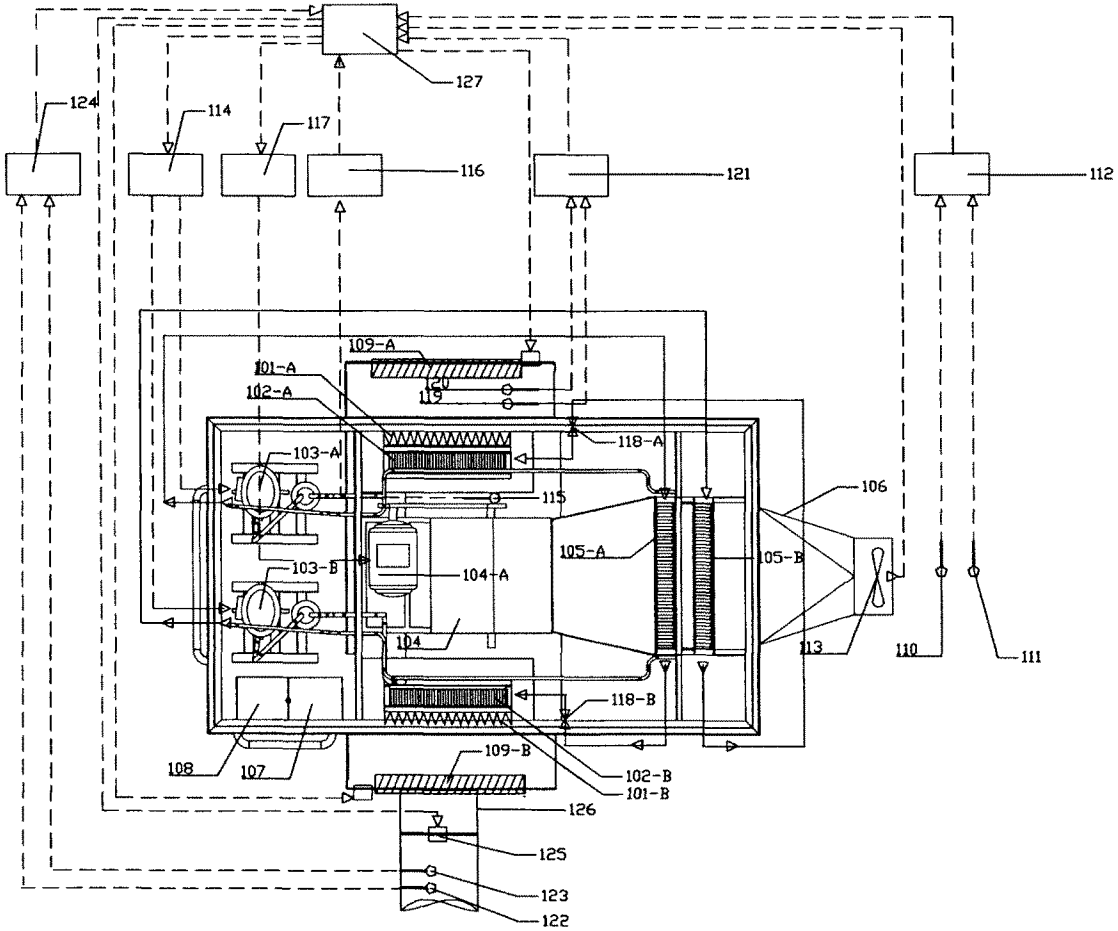
FIG. 1, showing the schematic diagram of the improved Air Dehydration and Heating Device.
Figure 2:
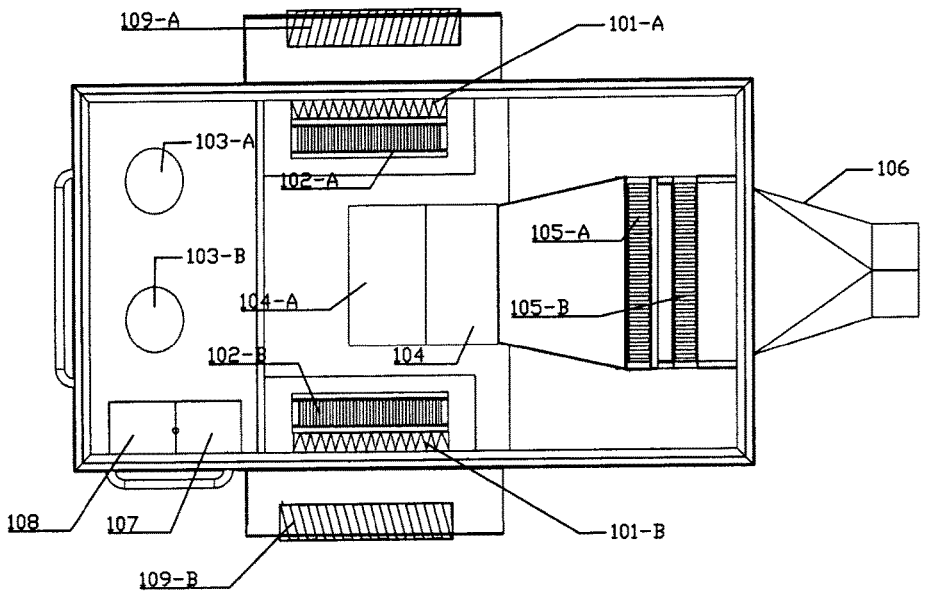
FIG. 2, showing the upper view of the Improved Air Dehydration and Heating Device.
Figure 3:
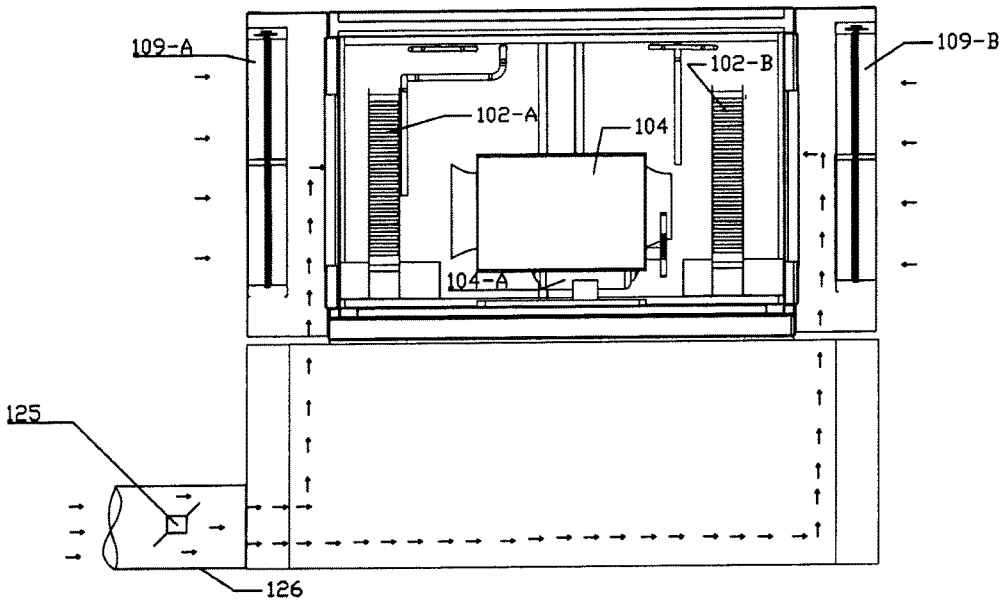
FIG. 3, showing the posterior, sectional view of the Improved Air Dehydration and Heating Device.

Equipment was developed, in part via rearrangement, to address necessities of air flow of condenser and evaporator sections. Air flows necessary for condensation usually are from 1.5 to 2.5 times the air flows necessary for evaporation. The drying air must be dehumidified and heated to comply with its purpose, and for such purpose, there is the necessity of passing the air through the evaporation serpentines in parallel (dehumidification action) and then in the serpentines of condensation in series (heating action).

Improvements in equipment aim at resolving the following problems, which were not adequately addressed by equipment of the patent document P10703605-1:

1. Adequate the necessities of air flow of the condenser and evaporator;
2. Increase the specific drying air rate ($m^3 \cdot min^{-1} \cdot t^{-1}$ of solid product) with the same frigorific capacity;
3. High load loss due to the rearrangement of the four serpentines in series;
4. Difficulty to clean serpentines of the device, due to limited space between them; and
5. Heating of the fan motor, for it operates in low temperature and low humidity environment.

The improvements to equipment (device) for air dehydration and heating brought the following benefits:

a) Greater drying efficiency, as it increased in 50% the specific drying flow, for instance, for an equipment of 364,000 Kcal/h, the specific rate changed from 11 to 16.5 $m^3 \cdot min^{-1} \cdot t^{-1}$ of solid product;

b) Greater efficiency and durability, due to the increase to the air flow in 50% in the serpentines of the condenser, which allows lower condensation temperatures and consequently more durability to the compressors, with the same frigorific capacity;

c) Less power and economy of the fan power due to the decrease of loss of power in the captivation, due to the passage of air is through three serial serpentines only;

d) Better ventilation and consequently more durability of the fan;

e) Easiness to clean the serpentines of evaporators and condensers, due to the new layout thereof; and f) Easiness to build.

Dehydration and Heating Device.

A device described in this application may provide drying air to be applied in dryers, greenhouses, or silos where the product is stationary, or to the reception line or any proper place that allows the injection of treated air, with the product exposed for time sufficient for the transfer of humidity.

Function of a device may consist in reducing the humidity of seeds and grains to levels between 8 and 14%, to preserve their sanitary and physiologic qualities during storage, as well as allowing conditions for the transfer of humidity of products or industrial processes.

As shown in the figures, improvements to a device can consist of: physical rearrangement of two serpentines of the evaporator (102-A) and (102-B), both in parallel, in series with two serpentines of the condenser (105-A) and (105-B), both arranged in series with components: pleated air filters (101-A) and (101-B) of large capacity to retain dust and air impurities, a first evaporator serpentine A (102-A) on the one side, and a second evaporator serpentine B (102-B) in parallel in the opposite side of the fan (104) in the center, one or more compressors (103-A) and (103-B), the fan (104) with a motor (104-A), a first serpentine of condenser (105-A) and a second serpentine of condenser (105-B) placed in series in front of the fan (104), drying air ducts (106), command panel (107), power panel (108), two dampers of outside air intake (109-A) and (109-B) aligned with the filter (101-A) and the evaporator serpentine (102-A) and filter (101-B) and the evaporator serpentine (102-B), respectively, drying air temperature sensor (110), drying air humidity sensor (111), digital controller of temperature and humidity of drying air properties (112), anemometer (113) positioned in the drying air outlet duct (106), frequency inverter of the compressor (114), outlet air temperature sensor of evaporators (115) positioned between both evaporators and before the air intake in the fan (104), outlet air temperature controller of evaporators (116), frequency inverter of the fan (117), cooling fluid expansion valve A (118-A), cooling fluid expansion valve B (118-B), outside air temperature sensor (119), outside air humidity sensor (120), digital controller of temperature and humidity of outside air properties (121), return drying air temperature sensor (122), return drying air relative humidity sensor (123), digital controller of temperature and humidity of the return drying air properties (124), return drying air intake damper (125) positioned in the return drying air intake duct (126) and main processor (127).

Alternatively, the condenser may consist of a single serpentine with frigorific capacity equivalent to two serpentines of the condenser (105-A) and (105-B).

The introduction of two dampers aims at matching the needs of the air flows that will circulate at the same time in the evaporators and condensers, and increase by 50% the specific drying rate ($m^3 \cdot min^{-1} \cdot t^{-1}$) of solid product. The installation of sensors and controllers of drying air and return air properties of the drying equipment allow the decision on which air to use and the respective quantities: new or re-circulated, and the installation of sensors and controllers of air in the intake of the evaporators allow the matching of the drying air with the specifications of temperature and humidity.

The process of control of the device described herein may be automatic or manual, both in the rotation of the motors of the compressors (103-A) and (103-B), and in the rotation of the fan (104) and from the information of temperature sensors (110), the information of the relative humidity sensor (111), information of the anemometer (113), information of temperature sensor (115), information of the temperature sensor (119), information of the relative humidity sensor (120), information of the temperature sensor (122) of the return drying air and information of the relative humidity sensor (123) of the return drying air, and in the case of automatic process with the air of the controllers of the main processor (127), provided with firmware or software with data on curves of overheat and sub-cooling and psychrometric abacus and limits of variation of temperature and relative humidity of the outlet air, which processes data and sends the signal to the frequency inverter of the compressor (114), which sends the signal to adjust the rotation of the compressors (103-A) and (103-B), also sending a signal to the frequency inverter of the fan (117), which sends a signal to adjust the rotations of the fan (104), to control the temperature and humidity of the drying air and the temperature range of the return drying air and additionally sends a signal for the opening of the dampers (109-A) and (109-B) to control the air flow into the evaporators (102-A) and (102-B) and signal for the opening of the damper (125) to control the return drying air flow.

Outside air can only be used when the ambient temperature is above 15° C., in order to avoid operational problems.

Controllers (112), (116), (121) and (124) may be exempted and their functions may be executed directly from the main processor (127).

What is claimed is:

1. An air dehydration and heating device comprising:

a first evaporator serpentine (102-A) and a second evaporator serpentine (102-B) in parallel, wherein the first evaporator serpentine (102-A) is in series with at least one condenser serpentine (105-A, 105-B) and wherein the second evaporator serpentine (102-B) is in series with the at least one condenser serpentine (105-A, 105-B);

one or more compressors (103-A, 103-B);

a first outside air intake damper (109-A) for the first evaporator serpentine (102-A) and a second outside air intake damper (109-B) for the second evaporator serpentine (102-B);

a fan motor (104-A) to drive a fan (104), the fan (104) being disposed intermediate the first evaporator serpentine (102-A) and the second evaporator serpentine (102-B), the at least one condenser serpentine (105-A, 105-B) being disposed in front of the fan (104);

a drying air outlet duct (106) to receive air moved by the fan (104), the air having passed through at least one of the first evaporator serpentine (102-A) and the second evaporator serpentine (102-B) and at least one of the at least one condenser serpentine (105-A, 105-B);

a return drying air intake damper (125) in a return drying air intake duct (126), where the return drying air intake duct (126) is in fluid communication with the first evaporator serpentine (102-A) and the second evaporator serpentine (102-B); and a processor (127) to control temperature and humidity of drying air in the drying air outlet duct (106) by at least in part controlling one or more of the dampers (109-A, 109-B, 125).

2. The air dehydration and heating device of claim 1 wherein the processor (127) controls temperature and humidity of drying air in the drying air outlet duct (106) by at least in part controlling the fan motor (104-A) or at least one of the at least one compressor (103-A, 103-B).

3. The air dehydration and heating device of claim 2 comprising a frequency inverter for the fan motor (104-A) and at least one frequency inverter for the at least one compressor (103-A, 103-B) wherein the processor (127) is configured for frequency inverter control.

4. The air dehydration and heating device of claim 1 comprising sensors.

5. The air dehydration and heating device of claim 4 wherein the sensors comprises at least one sensor from a group consisting of an intake air temperature sensor, an intake air relative humidity sensor, an outlet air temperature sensor, an outlet air relative humidity sensor, and an evaporator outlet air temperature sensor.

6. The air dehydration and heating device of claim 1 comprising:

a drying air temperature sensor (110), a drying air humidity sensor (111), an anemometer (113) positioned in the drying air outlet duct (106), an outlet air temperature sensor for evaporators (115), an outside air temperature sensor (119), an outside air humidity sensor (120), a return drying air temperature sensor (122), and a return drying air relative humidity sensor (123).

7. The air dehydration and heating device of claim 1 comprising:

a first cooling fluid expansion valve (118-A) disposed between a first condenser serpentine (105-A) and the first evaporator serpentine (102-A), and a second cooling fluid expansion valve (118-B) disposed between a second condenser serpentine (105-B) and the second evaporator serpentine (102-B).

8. The air dehydration and heating device of claim 1 wherein the processor (127) is configured to send a signal to adjust rotation of the fan motor (104-A), to control temperature and humidity of drying air and temperature range of return drying air, to send a signal for opening of the outside air intake dampers (109-A, 109-B) to control air flow into the first and second evaporator serpentines (102-A, 102-B) and to send a signal for opening of the return drying air intake damper (125) to control the return drying air flow.

9. The air dehydration and heating device of claim 1 comprising:

a first air filter (101-A) for the first evaporator serpentine (102-A), and a second air filter (101-B) for the second evaporator serpentine (102-B).

10. The air dehydration and heating device of claim 9 wherein the outside air intake dampers (109-A, 109-B) are aligned with the first air filter (101-A) and the first evaporator serpentine (102-A) and the second air filter (101-B) and the second evaporator serpentine (102-B), respectively.

11. The air dehydration and heating device of claim 1 wherein the processor (127) is configured to match amounts of air flows circulating through the evaporators and condensers at the same time by control of at least one of the dampers (109-A, 109-B, 125) to increase a specific drying rate ($m^3 \cdot min-1 \cdot t-1$) of solid product being dried by the drying air from the drying air outlet duct (106).

12. The air dehydration and heating device of claim 1 comprising:

sensors and controllers of properties of the drying air and return air of the air dehydration and heating device, thereby allowing a decision as to use of new air, return air or both and respective quantities, and sensors and controllers of air properties at the intake of the evaporator serpentines to control flow of drying air to meet specifications of temperature and humidity.

13. The air dehydration and heating device of claim 1 comprising a first condenser serpentine and a second condenser serpentine.

* * * * *